United States Patent [19]

Fleming

[11] Patent Number: 4,699,213

[45] Date of Patent: Oct. 13, 1987

[54] ENHANCED OIL RECOVERY PROCESS UTILIZING IN SITU STEAM GENERATION

[75] Inventor: Graham C. Fleming, Plano, Tex.

[73] Assignee: Atlantic Richfield Company, Los Angeles, Calif.

[21] Appl. No.: 866,420

[22] Filed: May 23, 1986

[51] Int. Cl.[4] ..... E21B 43/243

[52] U.S. Cl. ..... 166/260; 166/261

[58] Field of Search ..... 166/256, 260, 261

[56] References Cited

U.S. PATENT DOCUMENTS

| | | | |
|---|---|---|---|
| 2,642,943 | 6/1953 | Smith et al. | 166/261 |
| 2,788,071 | 4/1957 | Pelzer | 166/260 X |
| 3,126,954 | 3/1964 | Campion | 166/260 |
| 3,171,479 | 3/1965 | Parrish et al. | 166/261 |
| 3,174,543 | 3/1965 | Sharp | 166/261 X |
| 3,398,793 | 8/1968 | Milton, Jr. | 166/260 |
| 4,127,171 | 11/1978 | Allen | 166/260 |
| 4,252,191 | 2/1981 | Pusch et al. | 166/261 |
| 4,552,216 | 11/1985 | Wilson | 166/261 |
| 4,573,530 | 3/1986 | Audeh et al. | 166/260 |

*Primary Examiner*—George A. Suchfield

*Attorney, Agent, or Firm*—Frank J. Uxa; Michael E. Martin

[57] ABSTRACT

A process for recovering hydrocarbons from a porous hydrocarbon-bearing formation comprising: (a) injecting water and oxygen into the formation through an injection means and causing at least a portion of the oxygen to combust with a portion of the hydrocarbons in the formation, provided that the oxygen in the formation effectively remains a distance away from the production means, e.g., production well or wells; (b) injecting water, oxygen and hydrocarbons into the formation and causing at least a portion of the oxygen to combust with at least a portion of the injected hydrocarbons; and (c) recovering hydrocarbons from the formation through the production means.

9 Claims, No Drawings

ENHANCED OIL RECOVERY PROCESS UTILIZING IN SITU STEAM GENERATION

This invention relates to an improved process for recovery of hydrocarbons, e.g., crude petroleum, from a porous formation. More particularly, the invention relates to an improved enhanced oil recovery process for recovery of such hydrocarbons from a porous formation which involves injecting materials into the formation.

A large portion of the original oil in place in many oil-bearing subterranean formations remains in place after primary production. As oil reserves dwindle and exploration for new discoveries becomes more difficult and costly, the use of enhanced oil recovery (EOR) techniques on previously discovered resources will play an increasingly important role in the overall production of crude petroleum.

The following U.S. Patents, which relate to various EOR processes and techniques, where reviewed in preparing this application: 3,126,951; 3,157,230; 3,330,342; 3,354,953; 3,465,823; 4,467,868; and 4,558,740.

Various approaches to thermal EOR processing, e.g., steam soak, steam drive and in-situ combustion, have been suggested to reduce the viscosity of heavy, highly viscous oils, and thereby increase oil recovery. Steam flooding is one of the most common forms of EOR processing. Conventional steam flooding operations use steam generators on the surface, and inject the steam downhole through insulated tubing. To avoid heat losses in the wellbore, downhole steam generation has been suggested. This would also allow the injection of combustion flue gases (which result from steam generation) into the formation. Many designs for downhole steam generators have been suggested. However, it is difficult to provide such a device which is reliable in the corrosive downhole environment. It would be advantageous to provide for downhole steam generation without the difficulties encountered with downhole steam generating devices.

Therefore, one object of the present invention is to provide an improved process for the recovery of hydrocarbons.

Another object of the invention is to provide an improved process for the recovery of hydrocarbons without requiring the use of a downhole steam generating device.

A further object of the invention is to provide for improved recovery of hydrocarbons, e.g., crude petroleum, from a porous hydrocarbon-bearing formation which involves combusting a portion of such hydrocarbons. Other objects and advantages of the present invention will become apparent hereinafter.

An improved process for recovering hydrocarbons from a porous hydrocarbon-bearing formation through a production means, e.g., production well or wells, in fluid communication with the formation has been discovered. In one embodiment, the present process comprises: (a) injecting water and oxygen into the formation through an injection means, e.g., injection well or wells, in fluid communication with the formation and causing at least a portion of the injected oxygen to combust with a portion of the hydrocarbons in the formation, provided that the injected oxygen in the formation effectively remains a distance away from the production means, i.e., provided that there is no oxygen breakthrough to or combustion at the production means; (b) injecting water, oxygen and hydrocarbons into the formation through the injection means and causing at least a portion of the injected oxygen to combust with at least a portion of the injected hydrocarbons; and (c) recovering hydrocarbons from the formation through the production means.

The present process provides substantially all the advantages of downhole steam genertaion without requiring a downhole steam generating device. The present process generates steam in the formation so that there are substantially no wellbore heat losses and reduced heat losses in the near well region to the overburden and the underburden. If relatively pure oxygen, compared to air, is used in steps (a) and (b), the carbon dioxide generate also acts as a viscosity reducing agent for the hydrocarbons in the formation, thereby aiding recovery of hydrocarbons in step (c). The carbon dioxide generated may also be recovered as a valuable and salable by-product.

Compared to wet combustion only EOR processing, the present process has the distinct advantage of more effectively controlled combustion which can be reliably kept from propagating to the production means. This feature overcomes the problem apparent in many prior in situ combustion processes of oxygen breakthrough to, and the resulting abandonment of, producing wells. In the present process, step (a) is constratined to avoid combustion at the production means. The combustion which occurs in step (b) starts in a region still further away, relative to the region of the formation where the combustion of step (a) last takes place, from the producing means. Since both combustible materials, i.e., oxygen and injected hydrocarbons, are injected during step (b), the combustion in step (b) is very effectively controlled by controlling the amounts and injection rates of these combustible materials, as desired. The step (b) combustion preferably generates steam which acts as a drive fluid to drive the hydrocarbons in the porous formation toward the production means for recovery. The present process is particularly advantageous when used to recover crude petroleum. Recovery of viscous or heavy crude oils i.e., crude oils the recovery of which is made possible or is greatly enhanced by viscosity reduction, is particularly benefited by the practice of the present invention.

Step (a) of the present process may be considered modified, conventional wet combustion processing step. Water, preferably liquid water and oxygen are injected into the formation and the oxygen is caused to combust with at least a portion of the hydrocarbon. The water and oxygen may be injected together, as a mixture, or separately and substantially simultaneously. Also, if desired and/or convenient, the water and oxygen can be injected into the formation as alternating slugs of water and oxygen. Each of these and other water/oxygen injection options are within the scope of the present invention, provided that the injected oxygen is present in an amount and form to combust with a portion of the hydrocarbons in the formation during step (a) of the present process.

Initiation of combustion in step (a) may be accomplished in a conventional manner. However, the combustion is controlled, e.g., by controlling the injection of oxygen, so that the injection oxygen remains effectively away from the production means. In other words, the step (a) combustion is limited so that no such combustion takes place at the production means. Preferably, the step (a) combustion remains well away from the production means. Also preferably, only a minor amount, more preferably about 0.1% to about 10%, of the hydrocarbons in the total formation are combusted during step (a).

Any suitable source of oxygen may be employed in the present process. For example, the oxygen source may be substantially pure oxygen, oxygen enriched air (i.e., a mixture of air and oxygen in which the concentration of oxygen is greater than the oxygen concentration in air alone), air, oxygen depleted air and the like. It is preferred that a major portion, more preferably substantially all, of the oxygen be injected as a gas. The oxygen, in many cases a minor amount of the oxygen, may be dissolved or dispersed in the water. The oxygen may be mixed or combined with any other gas or gases, provided that such other gas or gases do not have a substantial detrimental effect on the process, on the formation being treated, or on the hydrocarbons to be recovered. Examples of such other gases include nitrogen, carbon dioxide, combustion flue gases, argon, other inert gases and the like. In one embodiment, the oxygen source is selected from the group consisting of substantially pure oxygen (e.g., at least about 90 mole % oxygen), and oxygen enriched air (e.g., at least about 40 mole % oxygen). These relatively high concentrations of oxygen can be beneficial since a relatively high concentration of carbon dioxide is produced during the combustion. As noted previously, carbon dioxide may be useful as a viscosity reducing agent for the hydrocarbons to be recovered and/or may be marketed as a valuable by-product of the present process.

Because of cost and availability considerations, the preferred oxygen source is air.

The amount of oxygen injected into the formation during step (a) may vary widely and is dependent on many factors related to the particular application involved. The amount of oxygen injected during step (a) should be sufficient to provide for the desired combustion. Preferably, a quantity of steam is generated during step (a) as the oxygen-formation hydrocarbons combustion continues e.g., in a direction away from the point or points of oxygen injection. The amount of oxygen injected in step (a) is preferably sufficient to combust hydrocarbons in the formation so that the region of the formation immediately surrounding the point or points of oxygen injection is substantially free of hydrocarbons capable of combusting with the oxygen injected into the formation during step (b).

The amounts of water injected during steps (a) and (b) may vary widely and depend on various factors. Preferably a major portion, more preferably substantially all of the water injected during steps (a) and (b) is injected as a liquid. It is preferred that such water injection be such as to build up a pool or region of liquid water at or adjacent to the point or points of oxygen injection in the formation. This region of liquid water preferably acts as a water source for steam generation during steps (a) and (b). Any suitable water source may be employed. For example, the water may be fresh water, brackish water, seawater (brine), mixtures thereof and the like. The water may include one or more additive materials, e.g., corrosion inhibitors, surface active agents and the like, as desired.

During step (a) heat and steam are generated. An elevated temperature wave or front moves outwardly from the combustion zone. The heat and steam generated at this point are at least partially transferred or carried to the other hydrocarbons in the formation. A portion of the water injected into the formation is converted into steam. Step (a) is preferably continued for a period of time so that the temperature of the formation at or near the point or points of injection is reduced relative to the maximum temperature condition at such point or points during step (a). More preferably, step (a) is continued until the temperature at the injection point or points is substantially the same as the temperature of the water being injected.

It is preferred that the flow of oxygen be stopped for a period of time after step (a). This provides one control mechanism so that the step (a) combustion does not proceed to the production means. This period with no oxygen injection should not be unduly long since heat losses can reduce the overall effectiveness of the present process.

An alternate approach involves proceeding substantially directly from step (a) to step (b). In this embodiment, the flow of water and oxygen into the formation is continued in accordance with step (a) and the injection of hydrocarbons into the formation is commenced. The combination of injected oxygen and injected hydrocarbons are caused to combust, thereby depleting the oxygen supply in the formation. With no oxygen available, the formation hydrocarbons do not combust and the step (a) combustion is terminated.

The amount of oxygen and hydrocarbons injected into the formation during step (b) should be sufficient to provide for the desired combustion. Preferably, this combustion and the resulting heat generate steam in the formation which acts to drive the hydrocarbons in the formation toward the production means for recovery. The amount of oxygen injected during step (b) is preferably sufficient to substantially completely combust (i.e., to carbon dioxide and water) the injected hydrocarbons. In one embodiment, the amount of oxygen injected during step (b) is preferably in the range of about 75% to about 125%, more preferably about 85% to about 110%, of the stochiometric amount of oxygen needed to completely combust the injected hydrocarbons. Excessive amounts of oxygen should be avoided during step (b) to inhibit combustion of the formation hydrocarbons.

Care should be taken to avoid the presence of explosive mixtures of hydrocarbons and oxygen in the injection means. Thus, for example, it may be prudent during step (b) to inject the oxygen and hydrocarbons in slugs, separated by a small nitrogen flush or by water injection. This sequential injection of oxygen and hydrocarbons is by definition within the scope of the present invention.

The sources of the oxygen and water to be injected in step (b) may be the same as or different from the oxygen and water sources in step (a). For convenience sake, it is preferred that the oxygen and water sources by the same for step (a) and (b).

Any suitable hydrocarbons may be injected into the formation during step (b). Preferably, such hydrocarbons are selected from among those which are substantially normally gaseous, i.e., at the conditions present in the formation. Such gaseous hydrocarbons are effectively combusted at formation conditions. Examples of such hydrocarbons include methane, ethane, propane, butane, natural gas and mixtures thereof. In one embodiment, processed or unprocessed natural gas from the same formation, or a geographically nearby formation, is used as the injection hydrocarbons in step (b). Thus, a potentially unmarketable resource, i.e., the natural gas, is effectively employed in the present EOR process.

Recovery of hydrocarbons from the formation through the production means, step (c), may occur using conventional and well known production techniques. Step (c) may occur while steps (a) and (b) are carried out. Step (c) is preferably carried out simultaneously with step (b) until the steam drive fluid preferably generated in steps (a) and (b) breaks through to the production means. One of the primary advantages of the present invention is that the present process prevents the breakthrough of large amounts of oxygen, therefore prolonging the useful life of the production well and increasing hydrocarbon recovery relative to straight wet combustion of the formation.

In employing the process of this invention in the exploitation of a petroleum-bearing porous formation, conventional production equipment is utilized. Because the system often requires the injection of fluids into a subterranean geological petroleum-bearing formation, a combination of injection and production means are employed. The injected fluids, including water, oxygen and hydrocarbons, are introduced into the injection means in a conventional manner. Because the particular practices and techniques employed for the injection of gaseous and/or liquid fluids into a porous formation are within the skill of one working in the art, and outside the scope of this invention, the mechanical equipment necessary for the introduction of the injected gases and/or liquids of this invention is left to the choice of such worker.

The following non-limiting example illustrates certain aspects of the present process.

EXAMPLE

A crude petroleum-bearing porous formation is selected for treating. The live oil viscosity of the crude petroleum in this formation is about 180 cp. The formation average temperature and pressure are about 150 degrees F. and 500 psi, respectively.

A production well and an injection well are drilled into the formation so that each of the wells is in fluid communication with the formation. Conditions are such that conventional primary recovery techniques are not effective to recover crude petroleum from the formation.

The injection well is used in inject liquid seawater and air into the formation. The air combusts with the crude petroleum in the formation. This combustion and the resulting heat generate steam. Initially after this injection is started the combustion causes the region of the formation surrounding the injection well to increase in temperature. As this injection and combustion continues, the region of the formation surrounding the injection well cool to the temperature of the injected seawater and a pool of water collects in this region.

At this point a new injection sequence is initiated. Alternating slugs of air/water/natural gas (from a nearby formation)/water are injected into the formation through the injection well. The amounts of air and natural gas are such that the amount of oxygen injected is equal to that amount required to completely combust the injected natural gas.

Through the injections noted above, the production well is employed to recover crude petroleum from the formation. A substantial amount of crude petroleum is effectively and economically recovered using the operation described above.

While the invention has been described with respect to various specific examples and embodiments, it is to be understood that the invention is not limited thereto and that it can be variously practiced within the scope of the following claims.

The embodiments of the present invention on which an exclusive property or privilege is claimed are as follows:

1. A process for recovering hydrocarbons from a porous hydrocarbon-bearing formation having a production means through which said hydrocarbons in said formation are recovered and an injection means through which materials may be injected into said formation, both said production means and said injection means being in fluid communication with said formation, said process comprising:

(a) injecting water and oxygen into said formation through said injection means and causing at least a portion of said oxygen to combust with a portion of said hydrocarbons in said formation to form a first expanding combustion front away from said injection means provided that said oxygen in said formation effectively remains a distance away from said production means and continuing said injection of water and oxygen and for a period of time such that the temperature of said formation at a region in said formation adjacent to said injection means is reduced to provide a pool of water in said formation between said first front and said injection means;

(b) injecting oxygen, water and hydrocarbons into said formation through said injection means and causing at least a portion of said oxygen to combust with at least a portion of said injected hydrocarbons along a second combustion front formed to generate a steam drive front between said pool of water and said first front for driving said hydrocarbons in said formation toward said production means; and (c) recovering hydrocarbons from said formation through said production means.

2. The process of claim 1 wherein substantially no combustion of said hydrocarbons in said formation occurs during step (b).

3. The process of claim 1 wherein said injected hydrocarbons are substantially normally gaseous.

4. The process of claim 1 wherein a major portion of the water injected in steps (a) and (b) is injected as liquid.

5. The process of claim 1 wherein a major portion of the oxygen injected in steps (a) and (b) is injected as gas.

6. The process of claim 1 wherein step (b) is carried out so as to substantially avoid the formation of an explosive mixture of oxygen and injected hydrocarbon.

7. The process of claim 1 wherein said hydrocarbons to be recovered comprise crude petroleum.

8. The process of claim 1 wherein the injection of water and oxygen in step (a) is ceased before commencing step (b).

9. The process of claim 1 wherein step (b) is carried out by injecting alternating slugs of air/water/natural gas through said injection means and wherein the amounts of air and natural gas are such that the amount of oxygen injected is equal to the amount required to completely combust the natural gas.

* * * * *